United States Patent [19]

Dowd

[11] 4,014,505

[45] Mar. 29, 1977

[54] NURSING BOTTLE SUPPORT

[75] Inventor: Harry J. Dowd, Phoenix, Ariz.

[73] Assignee: Dowd & Holbrook Enterprises, Inc., Tempe, Ariz.

[22] Filed: June 16, 1976

[21] Appl. No.: 691,281

[52] U.S. Cl. ..... 248/105; 248/279

[51] Int. Cl.[2] ..... A47D 15/00

[58] Field of Search ..... 248/102, 103, 104, 105, 248/106, 107, 279, 285, 286, 296

[56] References Cited

UNITED STATES PATENTS

| | | | |
|---|---|---|---|
| 1,501,080 | 7/1924 | Wickham | 248/102 |
| 1,863,163 | 6/1932 | Malti et al. | 248/102 |
| 2,647,714 | 8/1953 | Drill | 248/106 |
| 2,717,753 | 9/1955 | Schweikert | 248/106 |
| 3,120,368 | 2/1964 | Crisp | 248/103 |

*Primary Examiner*—Robert A. Hafer

*Attorney, Agent, or Firm*—James W. McFarland

[57] ABSTRACT

A nursing bottle holder is pivotally connected by a pair of hemispherical elements to a slotted, convexly curved base allowing shifting of a nursing bottle to opposite sides or in front of an infant. Provisions for quick and easy disassembly along with automatic indexing for re-assembly facilitates thorough cleansing of the entire assembly.

10 Claims, 10 Drawing Figures

NURSING BOTTLE SUPPORT

BACKGROUND OF THE INVENTION

This invention relates to adjustable nursing bottle supports or holders and relates more particularly to such supports which allow adjustment in a variety of directions and planes for proper infant feeding.

Exemplary of prior nursing bottle holders are the arrangements disclosed in U.S. Pat. Nos. 1,501,080 of Wickham; 2,269,609 of Taylor; 2,647,714 of Drill; 2,717,753 of Schweikert; 2,932,476 of Neibel et al; and 3,519,231 of Miller.

SUMMARY OF THE INVENTION

It is an important object of the present invention to provide an improved nursing bottle holder which incorporates a convexly curved, slotted, transverse stretch upon which the nursing bottle holder may be transversely shifted along the length of the convex portion so as to permit proper positioning of the nursing bottle with respect to the infant being fed.

A more particular object to the present invention is to provide a nursing bottle support as set forth in the preceding paragraph wherein pivotal connector means are provided for releasably securing the bottle holder to the transverse stretch and which permit generally universal positioning of the bottle holder, as well as transverse shifting along the convex portion.

A further particular object is to provide such a nursing bottle support wherein the connector means are so arranged and configured to facilitate easy disassembly of the entire unit for thorough cleansing, and which include indexing means for automatically assuring correct repositioning upon reassembly, thereby presenting a nursing bottle support of practical utility in that it may be quickly and easily assembled and reassembled.

In summary, the invention includes a unitary base having a pair of laterally extending, acute angular or trapezoidal side support stretches and a transversely extending, convexly curved, slotted stretch integrally joined with the two side lateral stretches. Connector means including a pair of hemispherical pivot elements disposed on opposite sides of the slotted stretch incorporate a pair of indexing pins or projections which extend through or around the slot for proper positioning of the two pivot elements relative to the slotted stretch. Each of the pivot elements has a V-shaped aperture therein for receiving an elongated, threaded stud upon which the bottle holder is affixed. By loosening a nut received on the threaded stud, the stud and bottle holder can be shifted within the V-shaped apertures in a plane extending generally perpendicular to the supporting portion of the slotted stretch. The holder is also rotatable about the axis of the elongated stud to provide essentially universal positioning of the bottle holder.

These and other more particular objects and advantages of the present invention are specifically set forth in or will become apparent from the following detailed description of preferred embodiments of the invention when read in conjunction with the accompanying drawings.

DETAILED DESCRIPTION OF THE PREFERRED EMBODIMENT

Figure 1:
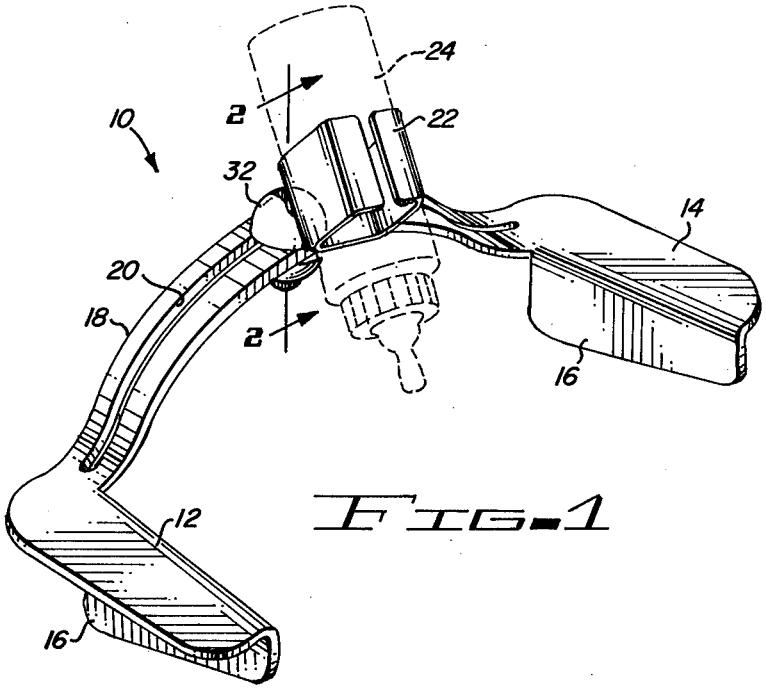
FIG. 1 is a perspective view of a nursing bottle support as contemplated by the present invention, with an exemplary nursing bottle shown in cooperation therewith.
Figure 2:
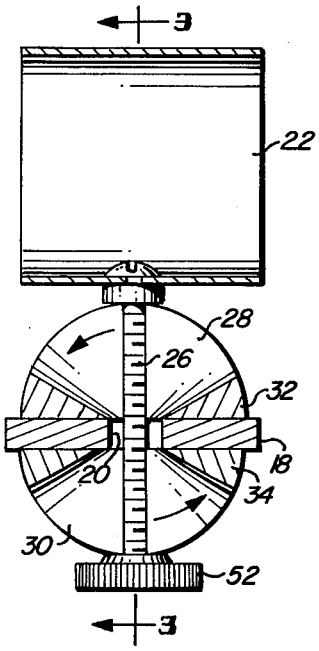
FIG. 2 is an elevational, cross-sectional view taken along lines 2—2 of FIG. 1.
Figure 3:
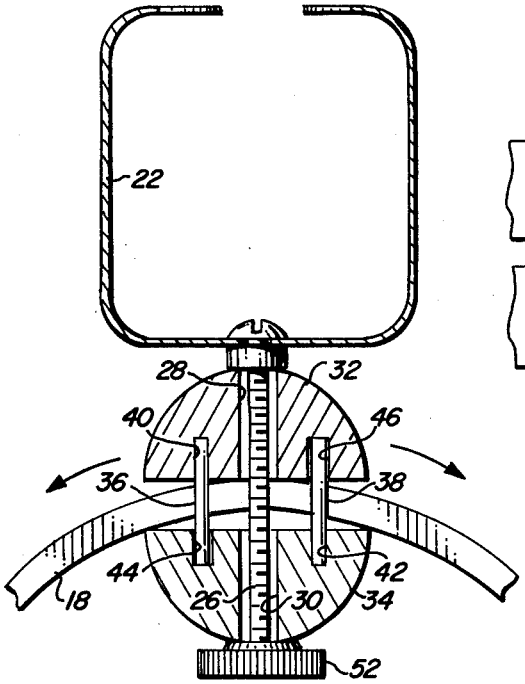
FIG. 3 is an elevational, cross-sectional view taken along lines 3—3 of FIG. 2.
Figure 5:
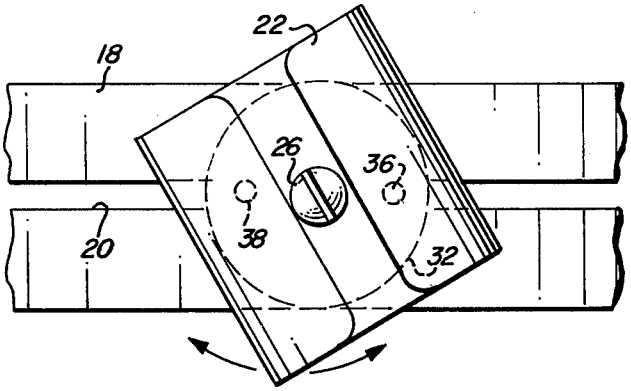
FIG. 5 is a top, partial, enlarged plan view of the bottle holder and slotted stretch.

Referring now more particularly to FIGS. 1–5 of the drawings wherein like reference numerals refer to the same structure throughout the various figures, a nursing bottle support is generally referred to by the numeral 10 and includes a unitary base comprising a pair of laterally extending side support stretches 12 and 14 each of which has a depending vertical, planar, trapezoidally shaped surface 16 adapted to engage the sides of a crib, car baby bed, infant seat or like structure utilized to carry or hold an infant. The vertical surfaces present a substantially solid base for support of the entire assembly 10 upon a flat surface, or alternately can frictionally engage the sides of the bed, seat, or the like.

The unitary base further includes a substantially transversely extending slotted stretch 18 having a through central slot 20 therewithin. Stretch 18 extends between and interconnects the lateral stretches 12 and 14. Stretch 18 is also relatively convexly curved as clearly illustrated in the figures so as to overlie the torso of an infant and thereby define a space therebeneath adapted to receive the infant. By virtue of the trapezoidal configuration of surfaces 16, stretches 12 and 14 locate stretch 18 in an elevated disposition facilitating proper positioning thereof relative to the infant while assuring a solid base for support 10.

A nursing bottle holder 22 is arranged and configured so as to frictionally receive and hold a baby bottle 24 shown by dashed lines in FIG. 1. Preferably holder 22 is configured so as to frictionally hold the baby bottle while still permitting shifting of the bottle therealong so as to allow relative positioning of the bottle closer to, or farther away from the child. The particular holder 22 illustrated is of generally rectangular configuration to receive a similarly configured baby bottle; however, it will be apparent to those skilled in the art that the particular shape and arrangement of holder 22 can be as desired to accomplish the result of frictionally holding the baby bottle.

Rigidly affixed to the bottom surface of the holder 22 is a generally vertically depending, elongated, threaded stud 26 which passes downwardly through slot 20 of stretch 18. Stud 26 also extends through a pair of aligned, narrow, slot type, V-shaped apertures 28 and 30 in a pair of substantially identical, hemispherically shaped pivot elements 32 and 34 which are respectively disposed on the upper and lower sides of stretch 18. A pair of indexing or alignment pins 36 and 38 are rigidly secured in a pair of diagonally opposed alignment holes 40 and 42 respectively within elements 32 and 34. Pins 36 and 38 extend generally vertically through slot 20 and are relatively loosely received within another pair of diagonally opposed alignment holes 44 and 46 within the pivotal elements. It will be apparent that when the support is disassembled, pin 36 will be retained with pivot element 32 and pin 38 will be retained with pivot element 34. The indexing means in the form of pins 36 and 38 relatively align the two pivot elements 32 and 34 so that their respective apertures 28 and 30 are in alignment with one another and lie in a plane 48 extending generally perpendicularly to the corresponding tangent portion 50 of slot 20 and slotted stretch 18 which directly receives and frictionally engages the corresponding surfaces of elements 32 and 34, which surfaces may be flat or contoured to conform to portion 50. The limits of the corresponding tangent portion 50 of stretch 18 are illustrated by dashed lines in FIG. 4.

Figure 4:
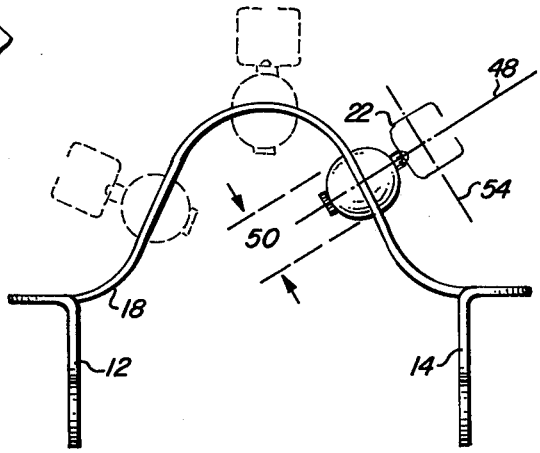
FIG. 4 is a front elevational view of the nursing bottle holder.
Figure 6:
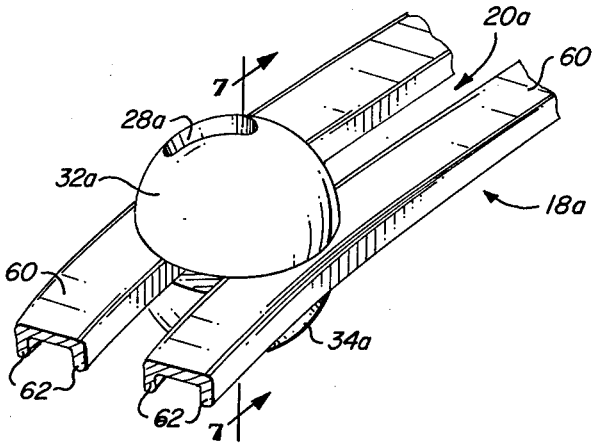
FIG. 6 is a fragmentary, perspective view of an alternate form of the invention.

A nut 52 is advanceable and retractable along elongated stud 26 to facilitate easy assembly and disassembly. When advanced along study 26, nut 52 firmly intersecures the holder 22 with the connector means comprising the two pivot elements 28, 30 as well as stud 26 and nut 52. Tightening of nut 52 also rigidly, releasably secures the holder 22 to the slotted stretch 18 of the unitary base. When nut 52 is retracted and loosened, it will be apparent that the holder 22 and stud 26 are rotatable or pivotal as a unit about the elongated central axis of stud 26, thereby allowing pivoting of holder 22 within a plane 54 as illustrated in FIG. 4. Also, this loosening of nut 52 allows the above described pivoting of holder 22 and nut 26 within the apertures 28 and 30 along plane 48. Furthermore, when the nut is loosened the entire assembly of holder 22, stud 26, and both pivot elements 28 and 30 are shiftable in unison along slot 20. In particular it is to be noted that the arrangement illustrated allows easy shifting of the bottle holder 22 and associated connector means along the convex portion of the stretch 18.

In use, the nursing bottle holder 22 along with the connector means can be shifted incrementally along stretch 18 to any position therealong. This allows positioning of the baby bottle on either side of the torso of the infant or anywhere in between. As a result, the nursing bottle support of the present invention can be utilized to assist in avoiding the undesirable tendency of the infant to habitually turn his head to one particular side at all times during feeding. After shifting the holder along slot 20, the holder is then relatively positioned to the baby's head by rotation within plane 48 and/or plane 54. Accordingly this facilitates proper positioning of the baby bottle with respect to the child and consequent proper and easy feeding thereof. Various exemplary positions of the bottle holder and connector means are illustrated in solid and dashed lines in FIG. 4. Once the bottle is properly positioned with respect to the child, which may include shifting of the bottle 24 within holder 22, nut 52 is advanced slightly along stud 26 to rigidly intersecure the assembly and assure that the bottle holder is rigidly held in position for feeding. It will be noted that the convex curvature of stretch 18 permits proper positioning of the baby bottle with respect to the child's mouth regardless of the position of the child's head, and yet the particular arrangement of connector means as contemplated by the present invention facilitates simple and easy sliding of the holder 22 along slot 20.

The entire support is quickly and easily disassembled for thorough cleansing purposes by removing nut 52 from stud 26. Holder 22, elements 28, 30 and the nut 52 immediately disassemble from one another and can be individually, thoroughly cleansed. Upon reassembly the two indexing pins 36 and 38 assure proper relative positioning of the two pivot elements 32 and 34 with respect to the slotted stretch 18. This feature of easy and correct reassembly thereby assures that the nursing bottle support is of practical utility for home use since it may be easily and thoroughly cleansed to minimize the dangers of infection to the infant.

FIGS. 6–10 illustrate an alternate embodiment of a slotted transverse stretch and cooperating hemispherical elements. Otherwise the arrangements shown in FIGS. 6–10 are similar to that of FIG. 1, incorporating the holder 22, stud 26, nut 52 and side support stretches 12 and 14 of FIG. 1.

More particularly, the slotted stretch 18-*a* includes a pair of parallel lengths 60 defining slot 20-*a* therebetween. Each length 60 includes one or a pair of depending side ribs 62. Top and bottom pivot elements 32-*a*, 34-*a*, respectively have narrow, slot type V-shaped apertures 28-*a* and 30-*a*.

Figure 7:
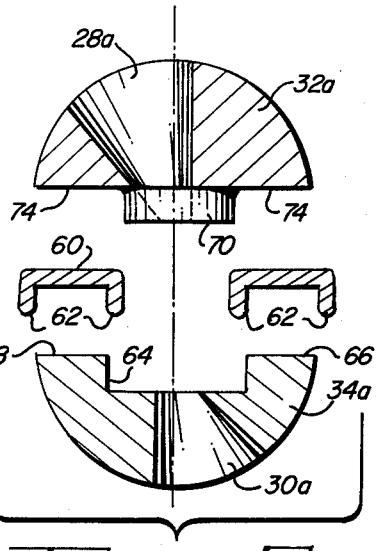
FIG. 7 is an exploded elevational, partially cross-sectional view taken along lines 7—7 of FIG. 6.
Figure 8:
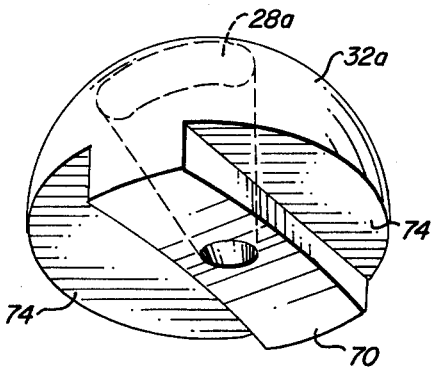
FIG. 8 is a bottom perspective view of the top pivot element in the FIG. 6 arrangement.
Figure 9:
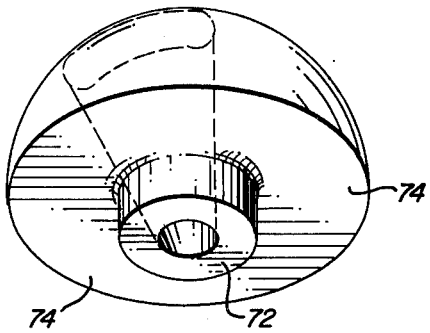
FIG. 9 is a view similar to FIG. 8 but showing another form of the top pivot element useful in the FIG. 6 arrangement.
Figure 10:
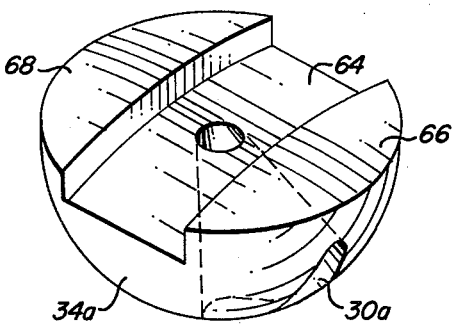
FIG. 10 is a top perspective view of the bottom pivot element in the FIG. 6 arrangement.

Bottom pivot element 34-*a* includes a central depression 64 extending generally parallel to stretch 18-*a* and perpendicular to aperture 30-*a*, to define upstanding side protrusions 66, 68 on opposite sides of depression 64. Depression 64, as depicted in FIG. 7, is of sufficient width to snugly receive the inner side ribs 62 of lengths 60 as well as a depending central protrusion 70 of top pivot element 32-*a*. Protrusion 70 may be of rectangular configuration running parallel to slot 20-*a* and perpendicular to aperture 28-*a* as shown in FIG. 8 to facilitate indexing of aperture 28-*a* relative to slot 20-*a*, or may be of circular configuration such as protrusion 72 of FIG. 9. In either case the protrusion 70 or 72 defines depressions 74 on opposite sides thereof for receiving the corresponding protrusions 66, 68 of the bottom element. In this connection it will be apparent that the indexing pins 36, 38 act as the indexing protrusions of FIG. 1, and the corresponding holes 40-46 act as the corresponding receiving depressions for these protrusions.

In the assembled disposition, the inner side ribs 62 are snugly fitted between protrusions 66, 68, 70, while the outer side ribs 62 snugly engage the outer periphery of protrusions 66 and 68 of the lower hemispherical element 34-*a*. In this manner both apertures 28-*a* and 30-*a* are automatically brought into alignment with one another to permit rotation of the bottle holder within a plane perpendicular to slot 20-*a*. Thus, it will be apparent that this arrangement permits rotation and positioning of the bottle holder in the same manner as accomplished in the FIG. 1 embodiment. In this connection, the vertical stud which passes through apertures 28-*a* and 30-*a* is loosened to permit shifting of the assemblage along stretch 18-*a*. In all other respects the arrangement shown in FIGS. 6–10 function as previously described relative to FIG. 1 with the exception that the automatic indexing upon assembly is accomplished by the protrusions 66, 68, 70 in placing of pins 36, 38. The surfaces of elements 32-*a* and 34-*a* which contact lengths 60 again are preferably contoured or curved generally complementary to those lengths as can best be seen in FIGS. 8 and 10. In the FIG. 9 arrangement, placement of the stud through apertures **28-*a* and 30-*a* accomplishes alignment of these two slots, while the position of central depression 64 effects indexing of slots 28-*a* and 30-*a* in a direction perpendicular to slot 20-*a* and the corresponding tangent portion of stretch 18-*a*.**

The foregoing detailed description of preferred arrangements of the invention should be considered exemplary in nature and not as limiting to the scope and spirit of the invention as set forth in the appended claims, since various modifications and alterations to the specific arrangement illustrated will be apparent to those skilled in the art.

Having described the invention with sufficient clarity that those skilled in the art may make and use it, I claim:

1. A nursing bottle support comprising:

a base having a pair of lateral support stretches and a transversely extending, slotted stretch interconnecting said lateral stretches, said slotted stretch being convexly curved and adapted to overlie the torso of an infant;

a holder adapted and configured to removably receive and hold a nursing bottle; and pivotal, shiftable connector means extending through the slot of said slotted stretch to releasably secure said holder on a corresponding portion of said slotted stretch, said connector means permitting pivoting of said holder in a pair of mutually perpendicular planes one of which extends substantially perpendicular to the plane of said corresponding portion of the slotted stretch, said connector means and holder being shiftable as a unit along said slot of the convexly curved, slotted stretch, said connector means including a pair of hemispherical elements disposed on opposite upper and lower sides of said slotted stretch with surfaces frictionally engaging said upper and lower sides, said elements having narrow, through apertures therein and relatively arranged with said apertures aligned and lying in said one of the mutually perpendicular planes.

2. A support as set forth in claim 1 wherein said surfaces of the elements are contoured generally complementary to said convexly curved slotted stretch.

3. A support as set forth in claim 1, wherein said connector means further includes an elongated threaded stud operably secured to said holder and depending downwardly therefrom through said aligned apertures and said slot, and a nut advanceable on said stud to secure said elements, said stud and said holder as a unit to said slotted stretch, said nut removable from said stud to facilitate disassembly of said support.

4. A support as set forth in claim 3, wherein said connector means further includes alignment protrusions received in complemental depressions in each of said elements.

5. A support as set forth in claim 4, wherein said protrusions include a central protrusion on one of said elements and a pair of side protrusions on the other of said elements, said side protrusions extending generally parallel to said slot, said slotted stretch having depending side ribs engagable with said side protrusions.

6. A support as set forth in claim 4, wherein said protrusions include an alignment pin mounted in each of said elements, and said depressions include complemental holes in each of said elements opening onto said surfaces of the elements.

7. A support as set forth in claim 1, wherein said lateral stretches have vertical, planar surfaces adapted to engage the sides of a crib or the like.

8. A support as set forth in claim 7, wherein said lateral and transverse stretches are integrally formed to present a unitary, one piece base, said planar surfaces of said lateral stretches being of trapezoidal configuration.

9. A support as set forth in claim 1, wherein said slotted stretch includes a central convex section, said holder and connector means being shiftable along said convex section and said connector means allowing adjustment of said holder to facilitate correct positioning of the baby bottle in all positions of the holder along the convex section.

10. A nursing bottle support comprising:

an integrally formed base having a pair of parallel, lateral support stretches each presenting vertical, planar, trapezoidal surfaces adapted to engage the sides of a crib, car baby bed, infant seat or the like, said base further including a slotted, overlying, transverse stretch interconnecting said lateral stretches, said transverse stretch having a transverse through slot and a central, convexly curved section defining a space therebeneath adapted to receive the torso of an infant, said central convexly curved section including a pair of parallel lengths defining said slot therebetween, each of said lengths having a vertically depending rib at the edge thereof;

a pair of hemispherical pivot elements disposed on opposite upper and lower sides of said slotted stretch, each of said elements having through apertures therein and alignment protrusions extending generally perpendicularly to said apertures, one of said elements having a central, rectangular protrusion defining side depression on opposite sides thereof, the other of said elements having a pair of side protrusions received in said side depressions, said other element further having a central, rectangular depression receiving said central protrusion, said ribs being received in said central depressions between said central and side protrusions;

a holder disposed above said elements and adapted and configured to removably, frictionally hold a nursing bottle;

an elongated threaded stud affixed to said holder and extending downwardly through said aligned apertures and said slot; and a nut disposed below said lower element and advanceable on said stud to rigidly intersecure said elements and said holder to said transverse stretch, said nut being retractable to permit rotation of said holder about the axis of said elongated stud, limited pivoting of said stud holder within said apertures, and unitary shifting of said holder, said stud and said elements along said transverse slot, said nut being removable from said stud to facilitate disassembly of said holder and elements from said base.

* * * * *